United States Patent [19]

Brown et al.

[11] Patent Number: 4,662,951

[45] Date of Patent: May 5, 1987

[54] PRE-HIP HEAT TREATMENT OF SUPERALLOY CASTINGS

[75] Inventors: Edgar E. Brown; Robert W. Hatala, both of South Windsor, Conn.

[73] Assignee: United Technologies Corporation, Hartford, Conn.

[21] Appl. No.: 565,489

[22] Filed: Dec. 27, 1983

[51] Int. Cl.[4] ..... C22F 1/10

[52] U.S. Cl. ..... 148/13; 148/20.3; 148/131

[58] Field of Search ..... 148/13, 20.3, 131, 3, 148/4

[56] References Cited

U.S. PATENT DOCUMENTS 3,753,790 8/1973 Walker et al. ..... 148/13

*Primary Examiner*—R. Dean

*Attorney, Agent, or Firm*—Charles E. Sohl

[57] ABSTRACT

Heat treatments are described which improve subsequent HIP treatment results of superalloy articles. The heat treatments substantially eliminate certain low melting phases which otherwise would cause problems relating to gas entrapment during a HIP process. The articles are heated to a temperature near but below the intended HIP temperature for a period of time sufficient to reduce the low melting phase.

2 Claims, 5 Drawing Figures

AS CAST
ARROWS SHOW
LAVES MATERIAL

AFTER 2175°F
EXPOSURE

ARROW SHOWS
MELTED REGION

AFTER HIP
"A" IS POROSITY

POST HIP
"B"
IS MELTED REGIONS

INVENTION

POST HIP
NO POROSITY
NO MELTING

PRE-HIP HEAT TREATMENT OF SUPERALLOY CASTINGS

DESCRIPTION

1. Technical Field

This invention relates to a heat treatment which can be applied to certain superalloy castings to eliminate melting and improve the results of subsequently applied hot isostatic pressing (HIP) treatments.

2. Background Art

Superalloys are materials, usually based on nickel or cobalt, which have useful properties at temperatures on the order of 1000° F. and above and find application in gas turbine engines. Superalloys maintain their strength to temperatures very near their melting temperature. Because of this extreme elevated temperature strength, superalloys are difficult to forge and often are used in cast form. Casting also permits the economic production of complex shapes which require minimum subsequent machining. However the properties of castings are limited by the porosity which invariably occurs during casting. Porosity is detrimental to mechanical properties and, in particular, can reduce high temperature porperties such as tensile ductility stress rupture life and low cycle fatigue. The complex superalloys are also sometimes prone to form low melting phases under certain conditions.

The techniques known as hot isostatic pressing (HIP) has been developed to reduce porosity in cast articles. In the HIP process, cast articles are placed in a chamber and heated to an elevated temperature while the chamber is simultaneously filled with a high pressure inert gas.

For many superalloys typical HIP process conditions are gas pressure of about 15,000 psi and a temperature of about 2000°-2200° F. The elevated temperature renders the material relatively soft and ductile and the high gas pressure forces closure of internal voids. At the same time homogenization occurs further increasing the article properties. Because superalloys maintain their strength to extremely high temperatures, HIPping of superalloys is often performed within 100° F. of their normal incipient melting temperature.

Recently in an effort to reduce the cost and the weight of gas turbine engines large complex superalloy castings have been evaluated as a substitute for complex parts now produced by machining forgings. A particularly useful alloy for certain applications is known as Inconel 718 (nominal composition Ni-19Cr-18Fe-5.2Nb-3Mo-0.9Ti-0.6Al-0.05C).

After solving many casting related problems and producing apparently useful castings (but containing porosity), the castings were given the usual HIP treatment in order to reduce porosity and segregation. Following the HIP treatment attempts were made to weld repair castings. Difficulty was encountered in welding the HIPped material in that substantial weld splatter was encountered along with abnormal porosity in the weld. It was also observed that some internal porosity had not been eliminated in certain areas of the casting. After a detailed investigation it was found that the difficulties encountered were the result of entrapment of the high pressure HIP media (argon gas) in pores connected to the surface either directly or by way of grain boundaries. The gas entrapment apparently resulted when local melting of the article occurred at the HIP temperature. Gas that had infused into the article by way of surface connected porosity or grain boundaries was trapped by resolidification of the melted material. It was found that this gas entrapment occurred at areas of the casting associated with slow cooling rates in the casting process and that the root of the problem was the presence of low melting Laves phases in areas of the casting which had cooled slowly. The present invention resulted from the discovery of this problem and the development of a solution which will subsequently be described.

U.S. Pat. Nos. 2,798,827; 3,753,790 and 3,783,032 teach the use of heat treatments at temperatures below but near the incipient melting temperature for periods of time sufficient to permit partial homogenization of low melting regions in superalloy articles, in particular, turbine blades whose incipient melting interfered with proper heat treatment. None of these patents refer explicitly to the Laves phases encountered in alloy Inconel 718 nor do they refer to the problem of gas entrapment during HIP treatment of nickel base castings.

DISCLOSURE OF INVENTION

This invention relates to the treatment of superalloy castings to substantially eliminate low melting phases to raise the incipient melting temperature of the alloy so that the alloy can be given HIP treatment without undergoing significant incipient melting and will thereby be free of adverse quantities of entrapped gases.

In a preferred form of the invention the heat treatment is conducted prior to the HIP treatment and this HIP treatment includes exposure at temperatures near but below the incipient melting temperature for a time sufficient to increase the incipient melting temperature to a temperature above that which will be employed in the HIP process. Stepped temperature treatments may be employed so that as the incipient melting temperature of the article increases the heat treatment temperature is also increased to shorten the time required to achieve the desired result. The heat treatment may be performed prior to the HIP process or may form a part of the HIP treatment sequence and may be performed in the HIP apparatus with or without the application of gas pressure.

An alternate form of the invention involves heat treating the article in a nonoxidizing environment without applied HIP pressure under conditions which cause melting of the low melting point phases since diffusion rates will be substantially increased and the time required to achieve the desired result will be substantially reduced.

The foregoing and other objects, features and advantages of the present invention will become more apparent in the light of the following detailed description of the preferred embodiments thereof as shown in the accompanying drawings.

BEST MODE FOR CARRYING OUT THE INVENTION

Figure 1:
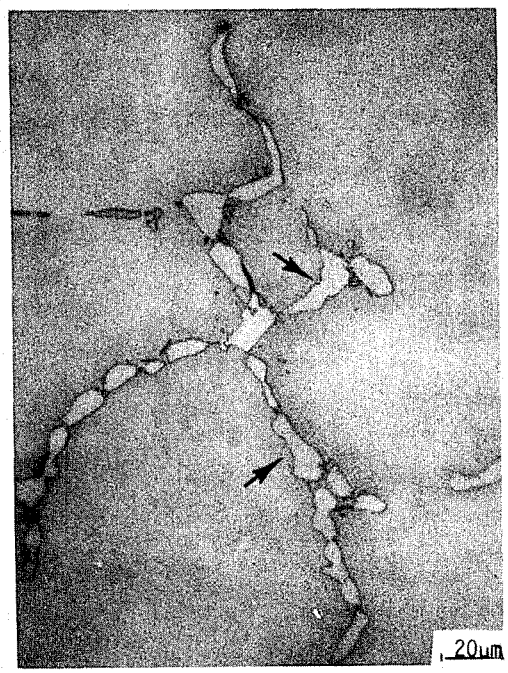
FIG. 1 is a photomicrograph of Inconel 718 material in the as cast condition.

The invention will be described with respect to its application to alloy Inconel 718 which is widely used for production of complex castings for use at intermediate temperatures. However, those skilled in the art will appreciate that the invention can be readily adapted for application to other alloys using routine engineering skills.

Inconel 718 has a nominal composition of 53Ni-19Cr-18Fe-5.2Nb-3Mo-0.9Ti-0.6A1-0.05C and may be HIPped at about 2175° F. for about 4 hours with an applied argon pressure of about 15,000 psi. The HIP temperature is selected to be one at which the alloy flow stress is sufficiently low to permit healing of porosity with an isostatic pressure of 15,000 psi. Other circumstances (different alloys, gas pressures, etc.) will necessitate different HIP temperatures. Those skilled in the art will readily be able to modify the HIP conditions as required.

In Inconel 718 material, the formation of Laves phases of the general formula $(Fe, Cr, Mn, Si)_2(Mo, Ti, Nb)$ is observed when the solidification rate is less than about 100° F. per minute. The volume fractions of Laves is inversely proportional to the solidification as shown in Table I. Accordingly, in cast Inconel 718 material, Laves phases are found in areas where thick sections of the casting have resulted in a slow cooling rate. Laves phases (Inconel 718) melt over an approximate temperature range of 2100–2150° F., about 25°–75° F. below that required for proper HIP processing of the material.

TABLE I

| Solidification Rate | Volume Percent Laves |
|---|---|
| > 100° F./min | < 1 |
| 30° F./min | 5 |
| 10° F./min | 7 |

The invention comprises heat treating the material to substantially homogenize the low melting phases to either eliminate them or to increase their melting temperature to a temperature above about 2175° F. (i.e. the intended HIP temperature). It will be appreciated that while total homogenization and/or an increase in incipient melting temperature to about the HIP temperature is preferred it may not be necessary in all cases. In particular it may be determined that a certain amount (i.e. less than 1%) of incipient melting can be tolerated. In such a case, the invention process can be modified to achieve this useable (though less than perfect) result. Table II presents a number of heat treatments which have been evaluated. These treatments were applied to an Inconel 718 casting containing about 7 volume percent of Laves phase. Treatments A and B fully homogenized the structure and no melting occurred either during the heat treatment or during subsequent HIP (at 2175° F.). Treatments C and D did not fully homogenize the structure although the amount of melting that occured during subsequent 2175° F. HIP operation was reduced to the point of precluding gas entrapment or reducing it to an undetectable level. Treatments E and F caused some incipient melting during the heat treatment and eliminated or substantially reduced melting during subsequent HIP operation to the point of precluding gas entrapment.

TABLE II

Cast Inconel 718 Pre-Hip Heat Treatments to Eliminate or Reduce Incipient Melting

| | |
|---|---|
| Treatment A | 2100° F. (24 hrs.) |
| Treatment B | 2075° F. (8 hrs.) + 2100° F. (16 hrs.) |
| Treatment C | 2100° F. (8 hrs.) |
| Treatment D | 2100° F. (16 hrs.) |
| Treatment E | 2100° F. (2 hrs.) + 2125° F. (2 hrs.) + 2150° F. (2 hrs.) |
| Treatment F | 2075° F. (2 hrs.) + 2100° F. (2 hrs.) + 2125° F. (2 hrs.) + 2150° F. (2 hrs.) |

Since the amount of low melting point segregation varies for different casting configurations due to differences in solidification rates, the specific treatment required to eliminate or significantly reduce the amount of incipient melting during subsequent HIPping will also vary with casting design and exact chemistry. Treatments A and B appear to be effective for castings exhibiting the most severe degree of segregation. Treatments C and D would be effective for those castings where the degree of segregation is less. Treatments E and F, illustrate treatments in which the temperature is progressively increased during the treatment. This is possible because of the decrease in Laves phases and/or increase in incipient melting temperatures resulting from diffusion. For those treatments which result in incipient melting during the treatment, the treatment should not be performed in the HIP apparatus (under superatmospheric conditions) as entrapment of gas could result.

Figure 2:
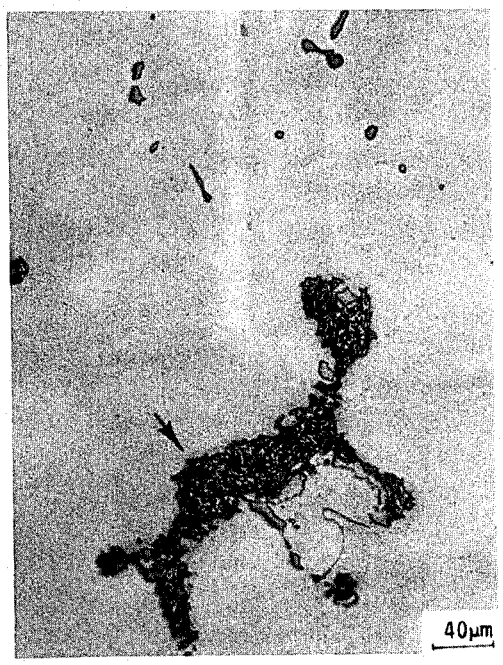
FIG. 2 is a photomicrograph of cast Inconel 718 material after exposure of 2175° F.
Figure 3:
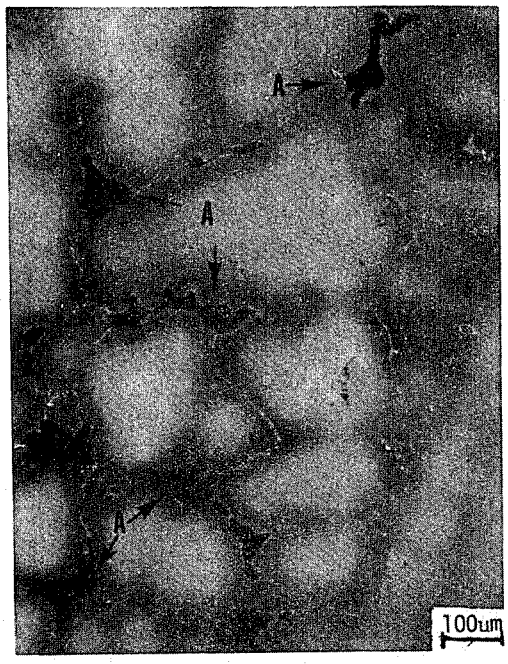
FIG. 3 PRIOR ART
FIGS. 3 and 4 are photographs of cast Inconel 718 material after a HIP treatment at 2175° F.
Figure 4:
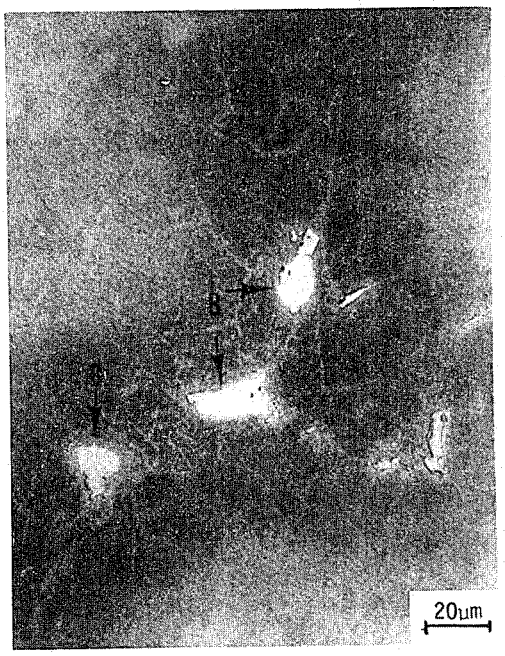
FIG. 4 PRIOR ART
Figure 5:
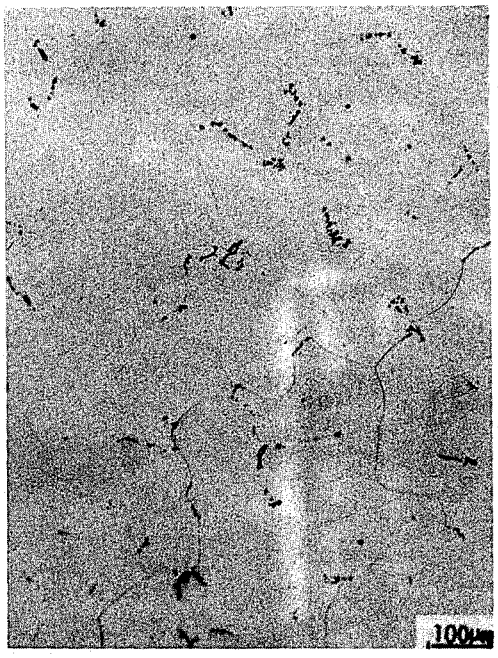
FIG. 5 is a photomicrograph of cast Inconel 718 material given the invention treatment and then HIP processed at 2175° F.

Various microstructural aspects of the invention (and non-invention) processes are illustrated in the figures. FIG. 1 shows the microstructure of Inconel 718 in the as cast condition. The discrete areas in the figure are the low melting Laves phases. FIG. 2 is a photomicrograph of the FIG. 1 material after an exposure at 2175° F., which is within the normal HIP temperature range for Inconel 718. Substantial melting has occurred and the properties of the material would be unsatisfactory as a result. FIGS. 3 and 4 show microstructural features of the Inconel 718 material after a HIP treatment at 2175° F. In FIG. 3 porosity associated with local melting can be seen; this porosity indicates that the desired goal of the HIP process was not achieved. FIG. 4 shows areas which melted during the HIP cycle, materials containing such features would not be acceptable for gas turbine engine useage. FIG. 5 is a photomicrograph of material treated according to the present invention (2075° F./8 hrs. plus 2100° F./16 hrs.) and subsequently HIP at 2175° F. No evidenced melting is present and no porosity is visible.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. In the method of reducing porosity in superalloy material which contains low melting phases having an initial melting temperature, by HIPing under particular conditions of temperature and pressure adequate to close internal porosity, and wherein the low melting phases melt at a temperature which is less than the required HIP temperature, the steps of a. heat treating the material to reduce the amount of the low melting phases and increase the melting temperature of said phases to a temperature equal to or greater than the required HIP temperature; and b. HIPing the material to reduce the porosity, whereby melting during the HIP step will be essentially eliminated and entrapment of the HIP media will not occur.

2. In the method of reducing porosity in superalloy material which contains low melting phases having an initial melting temperature, by HIPing under particular conditions of temperature and pressure adequate to close internal porosity, and wherein the low melting phases melt at a temperature which is less than the required HIP temperature, the steps of a. heat treating the material to reduce the amount of the low melting phases and increase the melting temperature to a temperature of said phases near but below the required HIP temperature; and b. HIPing the material to reduce the porosity, whereby melting during the HIP step will be reduced and entrapment of the HIP media will also be reduced to a level which will permit subsequent weld repair.

* * * * *